US010184673B2

(12) United States Patent
Kim et al.

(10) Patent No.: US 10,184,673 B2
(45) Date of Patent: Jan. 22, 2019

(54) PORTABLE AIR CONDITIONER

(71) Applicant: LG ELECTRONICS, INC., Seoul (KR)

(72) Inventors: Moohee Kim, Seoul (KR); Donghwal Lee, Seoul (KR); Hyuckjae Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 33 days.

(21) Appl. No.: 15/177,926

(22) Filed: Jun. 9, 2016

(65) Prior Publication Data

US 2016/0363329 A1 Dec. 15, 2016

(30) Foreign Application Priority Data

Jun. 10, 2015 (KR) ..... 10-2015-0081871
Jun. 10, 2015 (KR) ..... 10-2015-0081873

(51) Int. Cl.

| | |
|---|---|
| ***F24F 1/02*** | (2011.01) |
| ***F24F 13/02*** | (2006.01) |
| ***F24F 13/12*** | (2006.01) |
| ***F24F 13/20*** | (2006.01) |

(52) U.S. Cl.

CPC ..... *F24F 1/025* (2013.01); *F24F 13/0218* (2013.01); *F24F 13/0254* (2013.01); *F24F 13/12* (2013.01); *F24F 13/20* (2013.01); *F24F 2221/20* (2013.01)

(58) Field of Classification Search

CPC ..... F24F 1/025; F24F 13/20; F24F 13/0218; F24F 13/0254; F24F 13/12; F24F 2221/20

USPC ..... 285/7

See application file for complete search history.

(56) References Cited

U.S. PATENT DOCUMENTS

| | | | | |
|---|---|---|---|---|
| 3,030,650 A * | 4/1962 | Ernest Kiraly | A47L 9/0036 | 15/310 |
| 4,955,106 A * | 9/1990 | Stein | A47L 5/32 | 15/323 |
| 5,097,672 A * | 3/1992 | Takenaka | F24F 1/00 | 62/186 |
| 5,125,127 A * | 6/1992 | Bach | A47L 9/0045 | 15/323 |
| 5,742,976 A * | 4/1998 | Bensussen | A47L 9/0036 | 15/315 |
| 7,877,837 B2 * | 2/2011 | Gammack | A47L 5/362 | 15/323 |

(Continued)

FOREIGN PATENT DOCUMENTS

| | | |
|---|---|---|
| EP | 0 979 976 A2 | 2/2000 |
| EP | 1 876 396 A2 | 1/2008 |

(Continued)

*Primary Examiner* — Kun Kai Ma

(74) *Attorney, Agent, or Firm* — Dentons US LLP

(57) ABSTRACT

A portable air conditioner includes a case in which a condenser and an evaporator are integrally installed and an inlet and an outlet are formed; and an exhaust unit integrally coupled to the case and guiding air heat-exchanged with the condenser to an outdoor area, wherein the exhaust unit includes an exhaust pipe fixed to the case in one end thereof and disposed such that at least a portion thereof is inserted into the case and a shielding module fixed to the other end of the exhaust pipe and insertedly received in the case.

18 Claims, 9 Drawing Sheets

(56) References Cited

U.S. PATENT DOCUMENTS

| | | | | |
|---|---|---|---|---|
| 7,886,548 | B1 * | 2/2011 | Graves | B62B 9/00 62/272 |
| 8,695,152 | B2 * | 4/2014 | Lemchen | G06F 3/041 15/246 |
| 8,695,154 | B2 * | 4/2014 | Sever | A47L 9/0036 15/323 |
| D745,129 | S * | 12/2015 | Nakagawa | D23/364 |
| 9,574,337 | B1 * | 2/2017 | Lang | E03F 5/107 |
| 2002/0121101 | A1 * | 9/2002 | Jebaraj | F24F 1/025 62/259.1 |
| 2008/0000253 | A1 * | 1/2008 | Kim | F24F 1/025 62/291 |
| 2008/0093843 | A1 * | 4/2008 | Noroozi | B60H 1/00564 285/81 |
| 2008/0104988 | A1 * | 5/2008 | Lee | F24F 1/025 62/285 |
| 2009/0124192 | A1 * | 5/2009 | Ku | F24F 1/025 454/367 |
| 2009/0133368 | A1 * | 5/2009 | Calkins | A61M 16/08 55/383 |
| 2012/0090344 | A1 * | 4/2012 | Cho | E06B 7/03 62/262 |
| 2013/0180615 | A1 * | 7/2013 | Ragner | F16L 11/118 138/119 |
| 2014/0069543 | A1 * | 3/2014 | Chiu | F24F 1/025 138/109 |
| 2014/0299370 | A1 * | 10/2014 | Ikeda | B60R 16/027 174/72 A |

FOREIGN PATENT DOCUMENTS

| | | | |
|---|---|---|---|
| JP | 2006-138531 | A | 6/2006 |
| KR | 10-2006-0041833 | A | 5/2006 |
| KR | 10-2008-0041065 | A | 5/2008 |
| KR | 10-2008-0065202 | A | 7/2008 |
| KR | 10-2008-0075258 | A | 8/2008 |
| KR | 10-2009-0010420 | A | 1/2009 |

* cited by examiner

PORTABLE AIR CONDITIONER

CROSS-REFERENCE TO RELATED APPLICATIONS

The Application present application claims priority under 35 U.S.C. § 119 and 35 U.S.C. § 365 to Korean Patent No. 10-2015-0081871 (filed on Jun. 10, 2015), and Korean Patent Application No. 10-2015-0081873 (filed on Jun. 10, 2015), which are hereby incorporated by reference in their entirety.

BACKGROUND OF THE INVENTION

1. Field of the Invention

The present invention relates to a portable air conditioner.

2. Related Art

Air conditioners are generally installed in an indoor space or on a wall of vehicles, offices, or homes to cool or heat the indoor space. Air conditioners generally include components such as a compressor, an outdoor heat exchanger, an expansion valve, and an indoor heat exchanger. Air conditioners implement a refrigerating cycle or a heat pump cycle in which a refrigerant flows in a compressor, an outdoor heat exchanger, an expansion valve (capillary), and an indoor heat exchanger.

One type of air conditioner is a portable air conditioner, such as disclosed in Korean Patent Laid-Open Publication No. 10-2006-0026757. A portable air conditioner is typically installed in a location where it is difficult to install a separation type air conditioner (which includes an indoor unit and an outdoor unit). The portable air has a condenser and an evaporator are installed in a main body thereof, and is used only for performing cooling. The portable air conditioner may also have wheels so that it can be moved to a desirable location.

Using a conventional portable air conditioner, air heat-exchanged with the evaporator is discharged to an indoor area to cool indoor air, and air heat-exchanged with the condenser is discharged outwardly through an exhaust pipe. To this end, the portable air conditioner has the exhaust pipe guiding air heat-exchanged with the condenser to the outside.

Conventional portable air conditioners have an exhaust pipe that is detachably attached to the main body. The exhaust pipe is coupled to the main body only when used, and when the exhaust pipe is not in use, the exhaust pipe must be separated from the main body and stored in an extra space of the main body. Such configuration is problem some.

For example, conventional portable air conditioners require an extra receiving space to store the exhaust pipe. Also, because the exhaust pipe is detachably attached, additional assembly components (e.g., bolt, screw, etc.) are required for attaching and detaching the exhaust pipe. These assembly components may be lost or misplaced. Additionally, the exhaust pipe is very weak for a high load and thus frequently damaged (e.g., bent or broken during a storage process). Moreover, conventional portable air conditioners are sold in a state in which the exhaust pipe and the man body are separately packaged, thus increasing a volume of the product and transportation cost.

SUMMARY OF THE INVENTION

The embodiments of the present disclosure relate to an improved portable air conditioner.

According to an embodiment of the invention, an air conditioner includes a case and an exhaust unit. The case includes an inlet portion, an outlet portion, and an exhaust pipe fixing part. The exhaust unit is attached to the case and includes an exhaust pipe. The exhaust unit is configured to guide air that is heat-exchanged with a condenser to an outside area. The exhaust pipe is attached to the case and disposed such that at least a portion of the exhaust pipe is inserted in the case and a first end of the exhaust pipe is attached to the exhaust pipe fixing part.

According to another embodiment of the invention, the air conditioner includes a case having an exhaust pipe insertion recess into which at least a portion of the exhaust pipe is inserted.

According to another embodiment of the invention, the air conditioner includes an exhaust pipe insertion recess that is configured to receive at least a portion of an overall length of the exhaust pipe.

According to another embodiment of the invention, the air conditioner includes an exhaust pipe rotation shaft to connect the exhaust pipe fixing part to the case, wherein the exhaust pipe fixing part is configured to rotate at a predetermined angle with respect to the case, centered on the exhaust pipe rotation shaft.

According to another embodiment of the invention, the air conditioner includes a shielding module attached to a second end of the exhaust pipe, and a shielding coupling recess formed in the case, wherein at least a portion of the shielding module is insertedly received in the shielding coupling recess, According to another embodiment of the invention, the shielding module includes a first shielding part that is attached to the exhaust pipe, whereby the first shielding part has an opening to communicate with the exhaust pipe and discharge air guided through the exhaust pipe, a second shielding part that is attached to the first shielding part, whereby the second shielding part is configured to slidably move along the first shielding part, and a third shielding part that is attached to the second shielding part, whereby the third shielding part is configured to slidably move along the second shielding part.

The details of one or more embodiments are set forth in the accompanying drawings and the description below. Other features will be apparent from the description and drawings, and from the claims.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Figure 1:
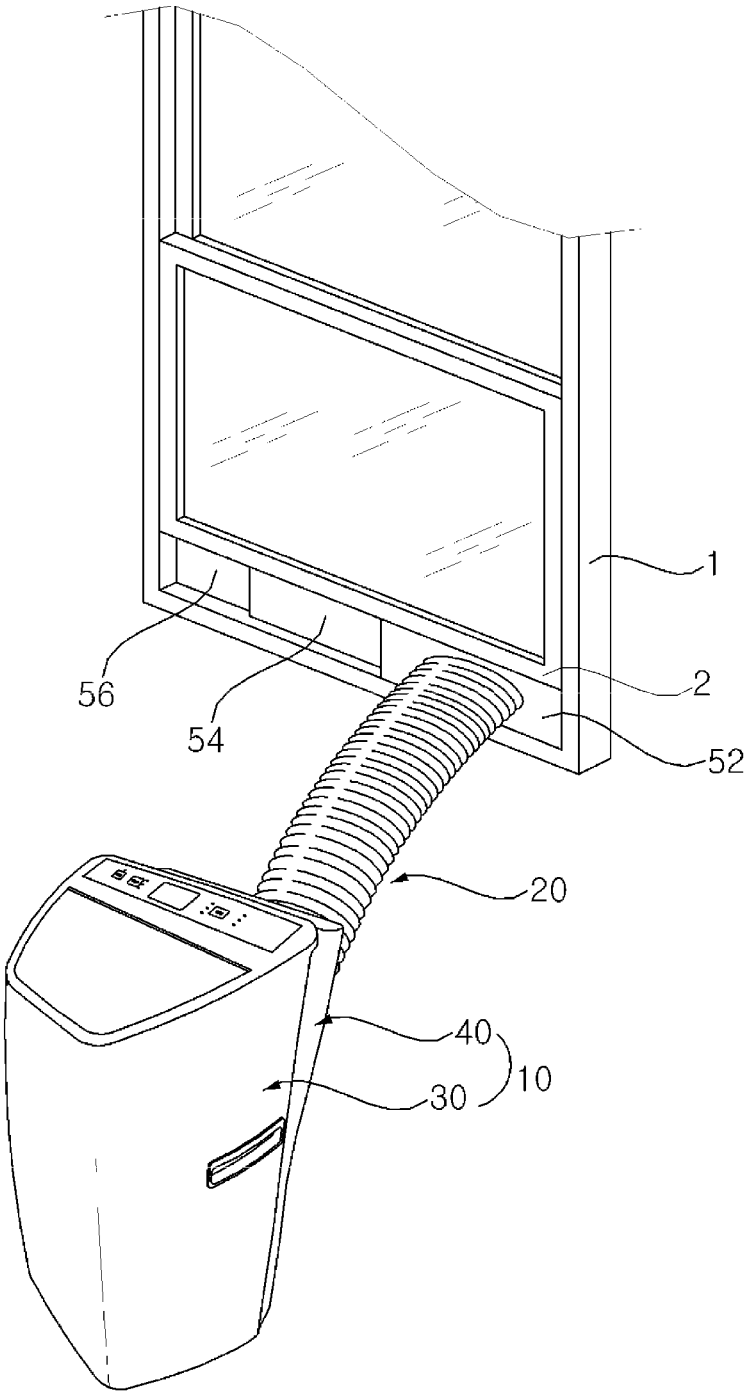
FIG. 1 is a perspective view illustrating installation of a portable air conditioner according to a first embodiment of the present disclosure.
Figure 2:
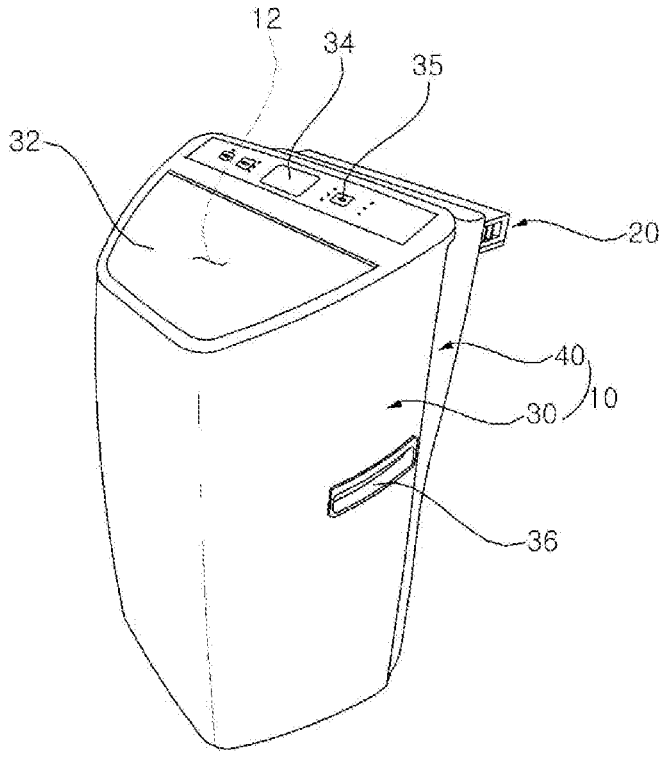
FIG. 2 is a perspective view of the portable air conditioner illustrated in FIG. 1.
Figure 3:
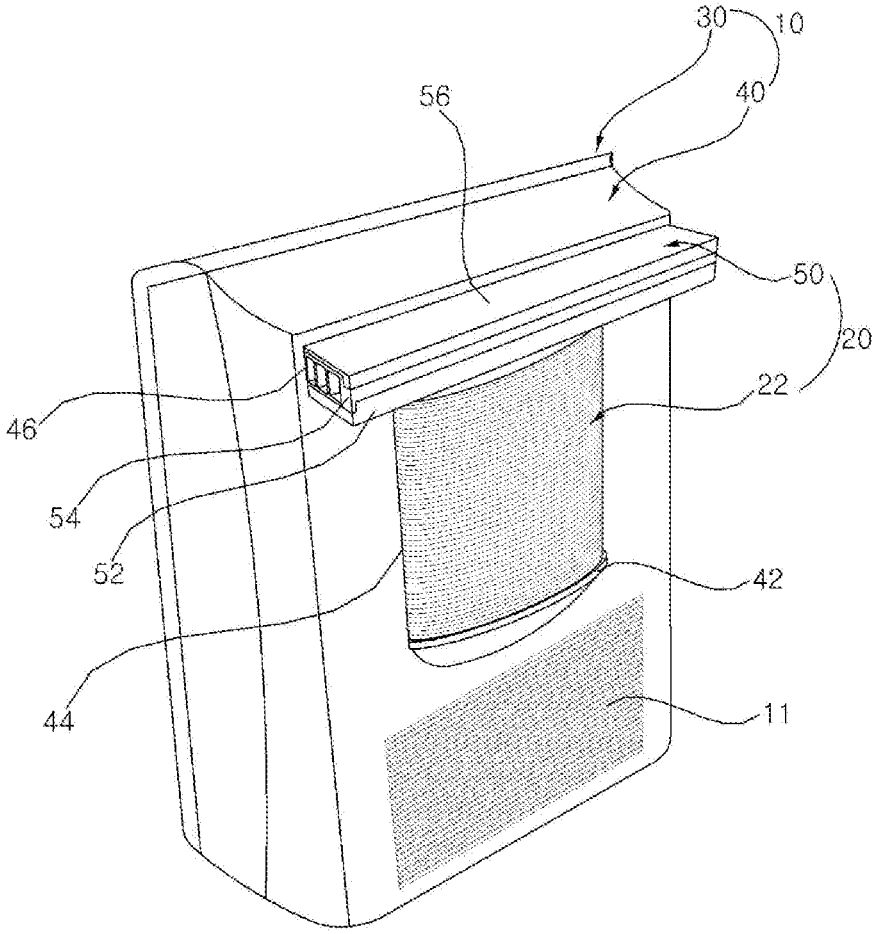
FIG. 3 is a perspective view illustrating a rear side of the portable air conditioner of FIG. 2.
Figure 4:
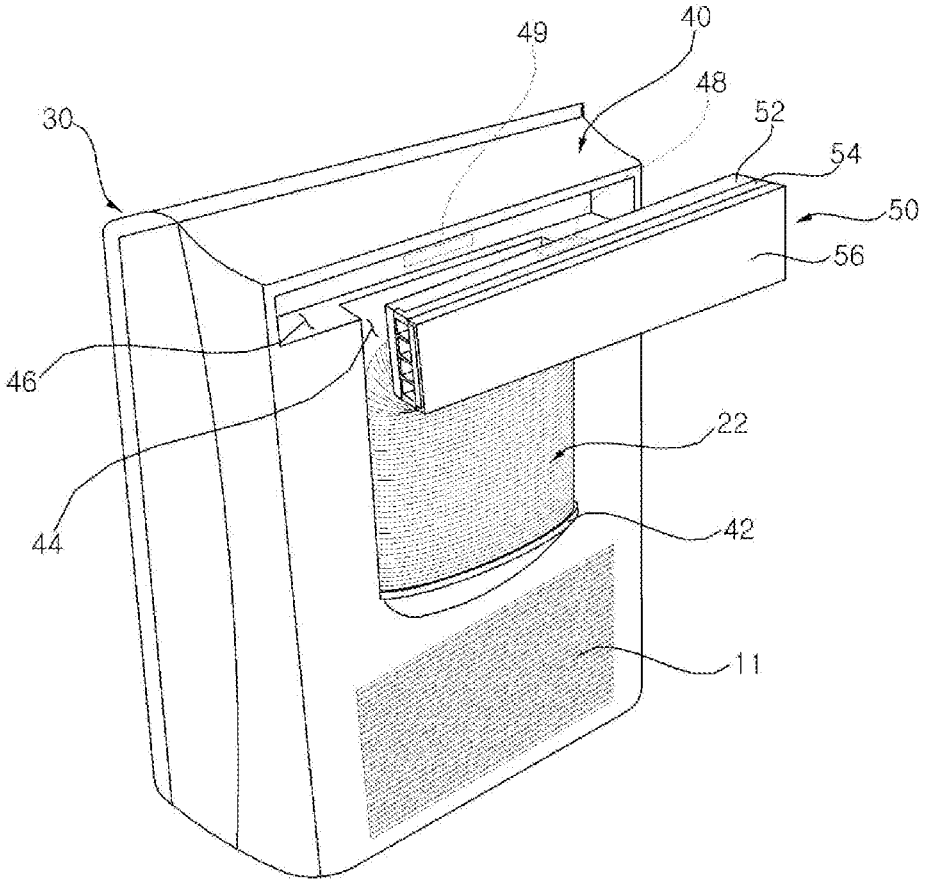
FIG. 4 is a perspective view illustrating a shielding module of FIG. 2.

Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

FIGS. 1 to 7 illustrate a portable air conditioner according to a first embodiment of the present disclosure. The potable air conditioner includes a case 10 including an inlet (e.g., an intake) 11 and an outlet 12 (e.g., a discharge opening) and an exhaust unit 20 integrally attached to the case 10.

As shown, the case 10 may include a front case 30 and a rear case 40. A wheel (not shown) may be disposed at a lower portion of the case 10. A discharge cover 32 to open and close the outlet 12 may be disposed on the front case 30. An operation button 35 to receive an operation signal from a user and a display 34 may be disposed on the front case 30. A handle unit 36 may be provided on a side portion of the front case 30.

The exhaust unit 20 may be integrally coupled to the rear case 40. The inlet 11 may be formed in a lower portion of the rear case 40. The exhaust unit 20 may be positioned above the inlet 11. A portion of the exhaust unit 20 may be inserted into the rear case 40 and the other remaining portion may protrudes outwardly from the rear case. Additionally, a compressor, a condenser, an expansion valve, an evaporator, and a blow fan may be provided within the case 10 to provide a refrigerating cycle of a refrigerant.

According to an embodiment of the invention, a portion of air intake through the inlet 11 may be heat-exchanged with the condenser and subsequently discharged outwardly through the exhaust unit 20. The remaining portion of the intaken air may be heat-exchanged with the evaporator and discharged to an indoor area through the outlet 12.

It is understood that two inlets may be provided, and in such configuration, air intaken from one inlet may be heat-exchanged with the condenser and subsequently discharged outwardly, and air intake from the other inlet may be heat-exchanged with the evaporator and subsequently discharged to the indoor area. Accordingly, a structure of the refrigerating cycle may be variously implemented according to design conditions. Similarly, a structure of the air flow path may be variously configured according to design conditions.

The exhaust unit 20 may be positioned above the rear case 40 and connected to a window. Instead, the exhaust unit 20 may be disposed below the rear case 40, and in this case, a connection length with the window may be increased.

The exhaust unit 20 may include an exhaust pipe 22 fixedly coupled to the rear case 40 and a shielding module 50 fixed to an end of the exhaust pipe 22 and fixed to the window. An exhaust pipe fixing part 42 to which one end of the exhaust pipe 22 is fixed may be provided on the rear case 40. The exhaust pipe fixing part 42 may be formed to face upwardly from the rear case.

One end of the exhaust pipe 22 may be attached to the exhaust pipe fixing part 42. More particularly, the exhaust pipe fixing part 42 may be formed such that one end of the exhaust pipe 22 is partially inserted inside an inner side of the rear case 40.

The exhaust pipe fixing part 42 may minimize an outwardly protruding thickness of the coupled exhaust pipe 22. More particularly, the exhaust pipe fixing part 42 formed to face upwardly may minimize a bent or protruding thickness of the exhaust pipe 22.

An exhaust pipe insertion recess 44 allowing the exhaust pipe 22 to be partially inserted therein may be formed above the exhaust pipe fixing part 42 on the rear case 40. A shielding coupling recess 46 may be formed on the rear case 40, and the shielding module 50 may be partially inserted into an upper portion of the exhaust pipe insertion recess 44.

The shielding coupling recess 46 and the exhaust pipe insertion recess 44 may be connected to each other. The shielding coupling recess 46 and the exhaust pipe insertion recess 44 may be formed to have a T shape.

The exhaust pipe fixing part 42 is configured to communicate with an interior of the rear case 40 to guide air.

The exhaust pipe fixing part 42 is formed to face upwardly relative to the ground. Alternatively, the exhaust pipe fixing part 42 may be configured to rotate at a predetermined angle with respect to the rear case 40.

The exhaust pipe fixing part 42 may be positioned above the inlet 11. In such configuration, flow resistance of air may be minimized.

The exhaust pipe 22 may be formed of a synthetic resin material having elasticity, but is not limited to such material.

The exhaust pipe 22 may be shaped in the form of a corrugate tube.

The exhaust pipe 22 formed as a corrugate tube may be received in a shrunken state (e.g., collapsed) inside the rear case 40. When the exhaust pipe 22 formed as a corrugate tube is installed in the window, a distance between creases in the corrugate tube may be increased (e.g., the corrugate tube is expanded).

The exhaust pipe 22 may be formed such that a cross-section thereof perpendicular to an air flow direction has an oval shape; however, the shape of the exhaust pipe 22 is not limited thereto. The oval exhaust pipe 2 may be disposed such that a longer axis thereof is in a traverse direction relative to the rear case 40 and a shorter axis thereof is in a forward/backward direction of the rear case 40. The oval shape of the exhaust pipe 22 facilitates installation of the exhaust pipe 22.

The exhaust pipe 22 may be partially inserted into the exhaust pipe insertion recess 44. For example, the exhaust pipe 22 may be inserted into the exhaust pipe insertion recess 44 in a shorter axis direction. In such configuration, a thickness of the exhaust pipe 22 protruding from the rear surface of the rear case 40 may be minimized. Moreover, because the exhaust pipe 22 is installed in the window positioned at a further rear side on the back of the case 100 and a bent forward/backward direction thereof is a shorter axis direction, the exhaust pipe 22 is more easily deformed.

One end of the exhaust pipe 22 may be fixedly attached to the exhaust pipe fixing part 42. For example, the one end of the exhaust pipe 22 may be fixed to the exhaust pipe fixing part 42 through a fastening member (not shown) such as a bolt or a screw, or through a connection unit such as a clamp (not shown).

The other end of the exhaust pipe 22 may be coupled to the shielding module 50. The shielding module 50 may be configured to communicate with the exhaust pipe 22 and discharge air to the exhaust pipe 22.

The shielding module 50 is configured to be insertedly fixed to an indoor window. For example, the shielding module 50 may block a gap of the open window to prevent ambient air from being introduced to an indoor area and discharge hot air heat-exchanged with the condenser to an outdoor area. The shielding module 50 may also prevent discharged air from being introduced again to an indoor area.

The length of the shielding module 50 may be adjusted to correspond to a length of the window.

The shielding module 50 may be coupled to the shielding coupling recess 46 of the rear case 40 so as to be perpendicular to the other end of the exhaust pipe 22.

Before being installed on the window, the shielding module 50 may be in a state of being coupled to the shielding coupling recess 46 of the rear case 40. In such configuration, a portion of the shielding module 50 may be inserted into the shielding coupling recess 46 and maintained in an insertedly coupled state.

According to an embodiment of the present disclosure, additional coupling force may be provided using a magnet 48 (e.g., a permanent magnet) to maintain the shielding module 50 in a more firmly or securely coupled state. For example, the magnet 48 may be installed in the shielding module 50 and a magnetic force corresponding member 49 forming magnetic force to correspond to the magnet 48 may be provided in the shielding coupling recess 46.

The magnetic force corresponding member 49 may be formed of a metal generating attraction with respect to the magnet 48, or a magnetic material may be used as the magnetic force corresponding member 49.

Figure 8:
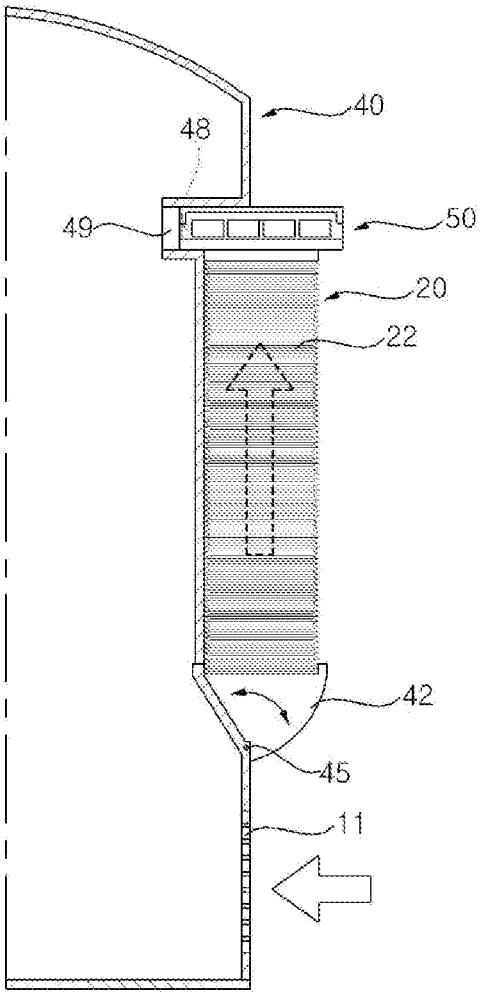
FIG. 8 is a cross-sectional view illustrating a coupling structure of an exhaust unit according to a second embodiment of the present disclosure.

The magnetic force corresponding member 49 may be disposed in the shielding coupling recess 46 such that it is exposed from an exterior of the rear case 40. However, as shown in FIG. 8, the magnetic force corresponding member 49 may be disposed at the inner side of the rear case 40.

Figure 5:
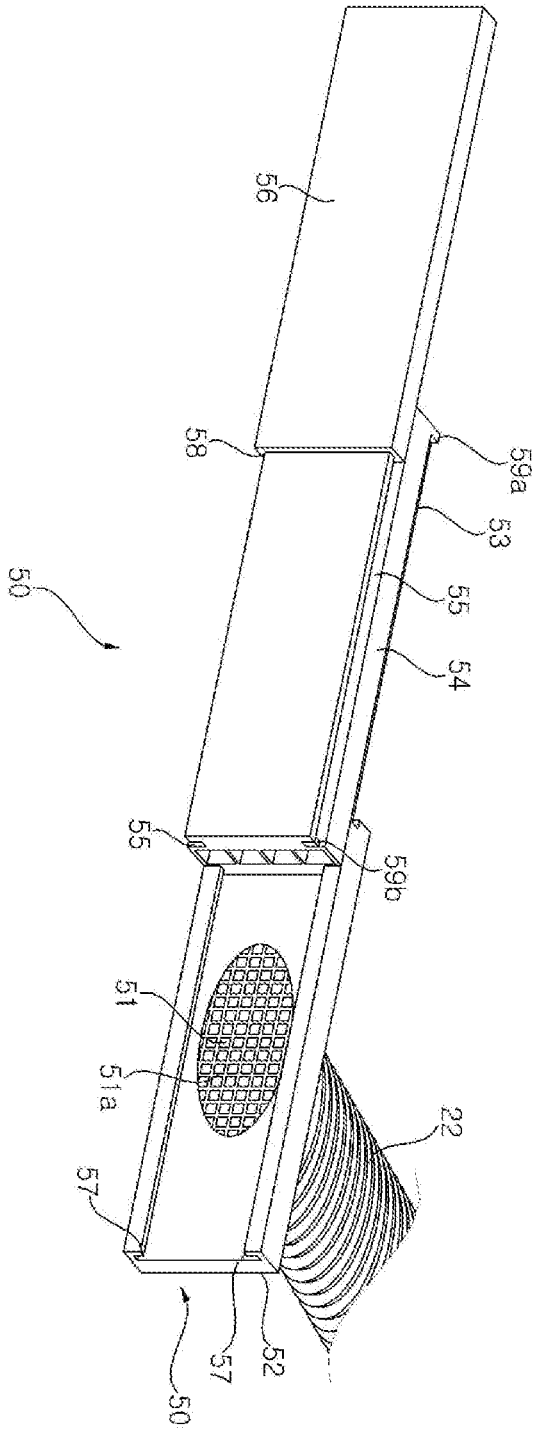
FIG. 5 is a view illustrating an expanded state of the shielding module illustrated in FIG. 2.
Figure 6:
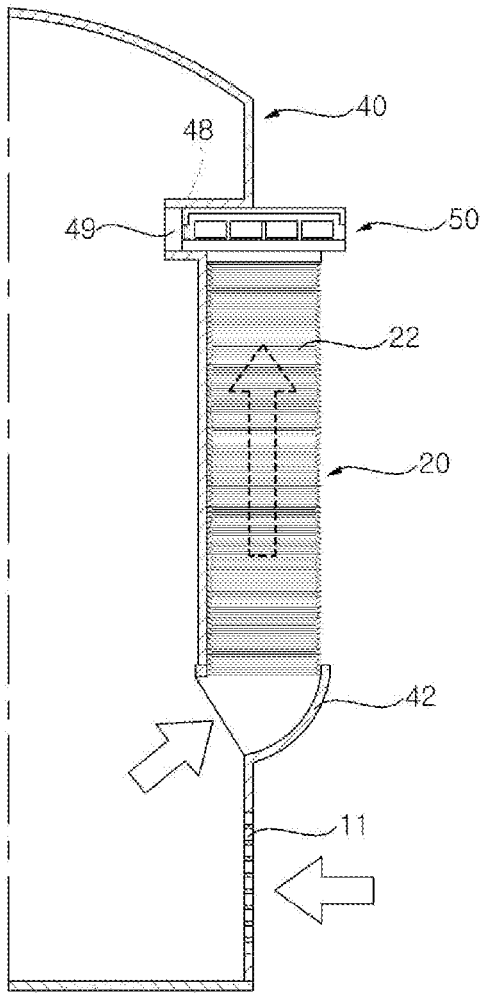
FIG. 6 is a cross-sectional view illustrating an installation of an exhaust unit illustrated in FIG. 3.
Figure 7:
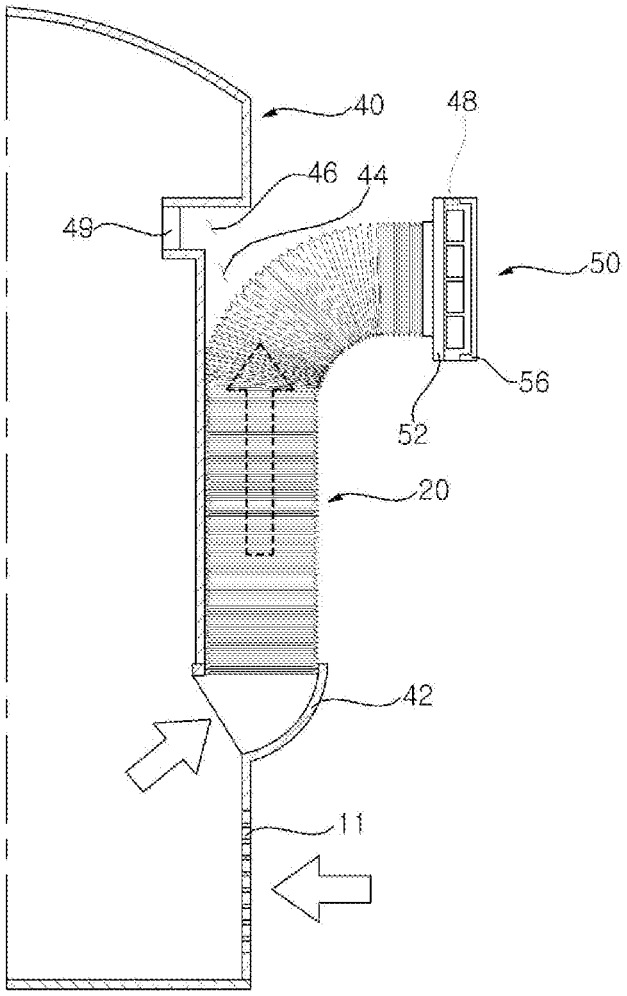
FIG. 7 is a view illustrating a use of the exhaust unit illustrated in FIG. 6.

According to an embodiment of the invention, as shown in FIG. 5, the shielding module 50 may include a first shielding part 52 coupled to the exhaust pipe 22 to discharge air, a second shielding part 54 slidably coupled to the first shielding part 52, and a third shielding part 56 slidably coupled to the second shielding part 54.

The first shielding part 52, the second shielding part 54, and the third shielding part 56 may be stacked together and inserted into the shielding coupling recess 46. When inserted into the shielding coupling recess 46, the first shielding part 52, the second shielding part 54, and the third shielding part 56 are sequentially in a stacked state. An overall width of the stacked first shielding part 52, the second shielding part 54, and the third shielding part 56 is configured to be partially inserted into the shielding coupling recess 46.

After the shielding module 50 is inserted into the shielding coupling recess 46, the shielding module 50 is pressurized downwardly due to a self-load of the exhaust pipe 22. The exhaust pipe 22 may be formed of an elastic material such that tensile force acting in a longitudinal direction is further formed in addition to the self-load.

The first shielding part 51 may be formed having an opening 51 to communicate with the exhaust pipe 22. A grid 51a may be formed in the opening 51 to prevent intrusion of an insect or an animal.

The second shielding part 54 may be slidably moved with respect to the first shielding part 52. Similarly, the second shielding part 54 may be slidably moved with respect to the third shielding part 56.

As shown in FIG. 5, the second shielding part 54 may be formed with a first rail 53 and a second rail 55. The first shielding part 52 may be configured to slidably move along the first rail 53. For example, the first shielding part 52 may be formed with a first guide 57 that is configured to move along the first rail 53 of the second shielding part 54. The first guide 57 may be formed to extend in a length direction. The first guide 57 may also be formed to cover the first rail 53.

The third shielding part 56 may be slidably moved along the second rail 55. For example, the third shielding part 56 may be formed with a second guide 58 that is configured to move along the second rail 55. Similar to the first guide 57, the second guide 58 may be formed to extend in a length direction. The second guide 58 may also be formed to cover the second rail 55.

According to the above configuration, the first shielding part 52, the second shielding part 54, and the third shielding part 56 are slidably moved in a length direction. The first shielding part 52, the second shielding part 54, and the third shielding part 56 may be sequentially stacked. However, it is understood that the shielding module 50 is not limited to three shielding parts and may instead include two shielding parts, or more than three shielding parts.

According to an embodiment of the invention, a first stopper 59*a* to limit a distance of a slidable movement may be formed between the first shielding part 52 and the second shielding part 54. Similarly, a second stopper 59*b* to limit a distance of a slidable movement may be formed between the second shielding part 54 and the third shielding part 56.

The embodiments of the invention have several advantages over conventional portable air conditioners. For example, according to the present disclosure, because the exhaust unit 20 is integrally manufactured with the case 10, an extra receiving space for keeping the exhaust unit 20 in storage is not required. Moreover, because the exhaust unit 20 is in a state of being received in the case 10, after the air conditioner is moved to an installation space, the exhaust unit 20 may be immediately installed without requiring further assembly. Moreover, because the shielding module 50 to be installed in the window 1 is received in the shielding coupling recess 46, movement and storage thereof are facilitated. Moreover, because the exhaust unit 20 is integrally manufactured, there is no need to assemble or separate the exhaust unit 20 to or from the case 10.

Hereinafter, an installation process of the exhaust unit according to an embodiment of the present disclosure will be described in more detail.

First, a shielding module 50 may be removed (e.g., drawn out or pulled out) from a shielding coupling recess 46 formed in a rear case 40 of the portable air conditioner.

The shielding module 50 may then be installed in a window 1.

A first shielding part 52, a second shielding part 54, and a third shielding part 56 that form a shielding module 50 may then be slidably moved to adjust to a width of the window 1. Again, it is understood that the shielding module is not limited to three shielding parts and instead may be formed of two shielding parts, or more than three shielding parts.

For example, when the width of the window 1 is small relative to the width of the shielding module 50, the second shielding part 54 and the third shielding part 56 may be installed so as to overlap each other.

After the width of the shielding module 50 is adjusted, the window 1 may be lowered and, due to a self-load of the window 1, the shielding module 50 may be fixed between a window frame 2 and the window 1.

At this time, a user may operate an operation button 35 provided in the case 10 to actuate the air conditioner.

When the air conditioner is driven, indoor air is intaken through an inlet 11 of the rear case 40. A portion of the intaken indoor air may then pass through a condenser.

Air heat-exchanged with the condenser may flow to an exhaust pipe 22 through an exhaust pipe fixing part 42 of the rear case 40 and then be guided to the shielding module 50 along the exhaust pipe 22.

Discharged air guided to the shielding module 50 may be outwardly discharged through the first shielding part 52.

Thereafter, when the exhaust unit 20 is received, the first shielding part 52, the second shielding part 54, and the third shielding part 56 of the shielding module 50 may each be slidably moved such that they overlap to each other so as to be arranged in their original state.

The stacked shielding module 50 may then be inserted into the shielding coupling recess 46 formed in the rear case 40. For example, the shielding module 50 may be inserted into the shielding coupling recess 46 in a traverse direction so that movement thereof in a longitudinal direction is limited.

After the shielding module 50 is inserted into the shielding coupling recess 46, a magnet 48 (e.g., permanent magnet) and a magnetic force corresponding member 49 generate magnetic attraction to each other so as to fix the shielding module 50 inside the shielding coupling recess 46 of the rear case 40. The magnet 48 and the magnetic force corresponding member 49 function to prevent the shielding module 50 from moving in a traverse direction.

When the shielding module 50 is inserted into the shielding coupling recess 46, the exhaust pipe 22 may also be inserted into an exhaust pipe insertion recess 44.

According to above configuration and installation process, because a portion of the exhaust unit 20 is inserted into an inner side of the rear case 40, any protrusion of the exhaust unit 20 from the back of the case 100 may be minimized.

Also, because a portion of the exhaust unit 20 is inserted into an inner side of the rear case 40, a center of gravity of the portable air conditioner may be stably maintained. It is understood that when the exhaust unit 20 is installed on an outer side of the rear case 40, rather than being inserted into an inner side of the depressed rear case 40, the center of gravity is moved to the back side of the case 10 thereby destabilizing the air conditioner unit. For example, when the center of gravity is moved to the back side of the case 10, the case 10 may fall backward (e.g., to the back side) when an external impact is applied thereto, thereby damaging the portable air conditioner or causing an accident.

Another embodiment of the present discourse will be described with reference to FIG. 8. Referring to FIG. 8, an exhaust unit 20 may be configured to rotate at a predetermined angle with respect to the rear case 40. More specifically, an exhaust pipe fixing part 42 to connect the exhaust pipe 22 with the rear case 40 may rotate at a predetermined angle with respect to the rear case 40.

To this end, an exhaust pipe rotation shaft 45 may be formed between the exhaust pipe fixing part 42 and the rear case 40. The exhaust pipe rotation shaft 45 may be disposed at a lower portion of the exhaust pipe fixing part 42.

An upper portion of the exhaust pipe fixing part 42 may be rotated centered on the exhaust pipe rotation shaft 45. Accordingly, when the exhaust unit 20 is installed and the exhaust pipe 22 is drawn out, the exhaust pipe fixing part 42 is rotated centered on the exhaust pipe rotation shaft 45.

An exhaust pipe stopper (not shown) may be provided to limit a rotation angle of the exhaust pipe fixing part 42. The exhaust pipe stopper may be formed in any one of the rear case 40 and the exhaust pipe fixing part 42.

A maximum rotation angle of the exhaust pipe fixing part 42 may be set to about 45 degrees, but is not limited thereto.

The other components shown in FIG. 8 are the same as those shown in FIGS. 1-7 and discussed above. Thus, for convenience purposes, a detailed description thereof is omitted.

Figure 9:
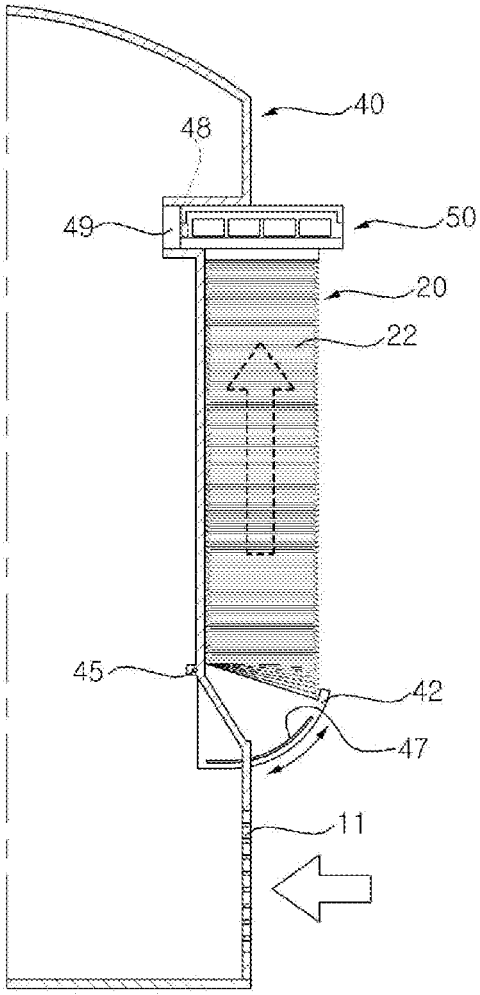
FIG. 9 is a cross-sectional view illustrating a coupling structure of an exhaust unit according to a third embodiment of the present disclosure.

Another embodiment of the present disclosure will be described with reference to FIG. 9. Referring to FIG. 9, unlike the embodiment shown in FIG. 8, the exhaust pipe fixing part 42 may be configured to rotate while being inserted into an inner side of the rear case 40.

To this end, the exhaust pipe rotation shaft 45 may be disposed above the exhaust pipe fixing part 42. A lower portion of the exhaust pipe fixing part 42 may be rotated centered on the exhaust pipe rotation shaft 45 disposed thereabove.

A fixing part guide 47 may be formed in the exhaust pipe fixing part 42 in order to guide rotation of the exhaust pipe fixing part 42. The fixing part guide 47 may have a circular arc shape, but is not limited thereto.

A guide protrusion (not shown) corresponding to the fixing part guide may be formed in the rear case 40. Accordingly, when the exhaust pipe 22 is drawn out, the exhaust pipe fixing part 42 may be rotated while being inserted into the rear case 40.

According to the embodiment of FIG. 9, the exhaust pipe fixing part 42 may be rotated according to a load applied to the exhaust pipe fixing part 42. More particularly, an effect of distributing a load acting on the exhaust pipe fixing part 42 to the exhaust pipe rotation shaft 45, the fixing part guide 47, and the guide protrusion may be obtained.

The other components shown in FIG. 9 are the same as those shown in FIG. 8 and discussed above. Thus, for convenience purposes, a detailed description thereof is omitted.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case having an inlet portion, an outlet portion, and an exhaust pipe fixing part; and an exhaust unit attached to the case, the exhaust unit having an exhaust pipe and configured to guide air that is heat-exchanged with a condenser to an outside area; and a shielding module attached to a second end of the exhaust pipe, the shielding module and the exhaust pipe forming a T-shape, wherein the case has a shielding coupling recess formed in the case, wherein the exhaust pipe is attached to the case and disposed such that at least a portion of the exhaust pipe is inserted in the case and a first end of the exhaust pipe is attached to the exhaust pipe fixing part, wherein the shielding module is fixedly caught by the shielding coupling recess according to a self-load of the exhaust pipe and the shielding module when the shielding module is inserted into shielding coupling recess, and wherein a magnet is disposed in one of the shielding module and the shielding coupling recess, and a magnetic force corresponding member forming a mutual attraction with the magnet is disposed in the other of the shielding module and the shielding coupling recess.

2. The air conditioner of claim 1, wherein the exhaust unit is disposed above the inlet portion.

3. The air conditioner of claim 1, wherein the case comprises:

an exhaust pipe insertion recess into which at least a portion of the exhaust pipe is inserted.

4. The air conditioner of claim 3, wherein the exhaust pipe fixing part is disposed above the inlet portion.

5. The air conditioner of claim 3, wherein the exhaust pipe insertion recess is disposed above the exhaust pipe fixing part.

6. The air conditioner of claim 3, wherein the exhaust pipe insertion recess is configured to receive at least a portion of an overall length of the exhaust pipe.

7. The air conditioner of claim 3, wherein the exhaust pipe has an oval shape, and the exhaust pipe insertion recess is formed in a shorter axis direction of the exhaust pipe.

8. The air conditioner of claim 3, further comprising:

an exhaust pipe rotation shaft to connect the exhaust pipe fixing part to the case, wherein the exhaust pipe fixing part is configured to rotate at a predetermined angle with respect to the case, centered on the exhaust pipe rotation shaft.

9. The air conditioner of claim 3, wherein the exhaust pipe fixing part is formed to face upward relative to the ground.

10. The air conditioner of claim 1, wherein the exhaust pipe is a corrugate tube with grooves formed in a lengthwise direction.

11. The air conditioner of claim 1, wherein the exhaust pipe insertion recess and the shielding coupling recess are disposed above the exhaust pipe fixing part.

12. The air conditioner of claim 1, wherein the exhaust pipe insertion recess and the shielding coupling recess together form a T shape in the case.

13. The air conditioner of claim 1, wherein the shielding module comprises:

a first shielding part attached to the exhaust pipe, the first shielding part having an opening to communicate with the exhaust pipe and discharge air guided through the exhaust pipe;

a second shielding part attached to the first shielding part, the second shielding part configured to slidably move along the first shielding part; and a third shielding part attached to the second shielding part, the third shielding part configured to slidably move along the second shielding part.

14. The air conditioner of claim 13, wherein the magnet is disposed in the second shielding part, and the magnetic force corresponding member forming a mutual attraction with the magnet is disposed in the shielding coupling recess.

15. The air conditioner of claim 13, wherein the first shielding part, second shielding part, and third shielding part are provided in a stacked configuration relative to each other.

16. The air conditioner of claim 1, further comprising:

a shielding module attached to a second end of the exhaust pipe and having at least a portion thereof that is received in the case, wherein the case comprises:

a shielding coupling recess to receive at least the portion of the shielding module, and an exhaust pipe insertion recess to receive at least a portion of the exhaust pipe.

17. The air conditioner of claim 16, wherein the exhaust pipe insertion recess and the shielding coupling recess are disposed above the exhaust pipe fixing part.

18. The air conditioner of claim 1, further comprising an evaporator, wherein the evaporator and condenser are integrally provided inside the case.

* * * * *